United States Patent [19]

Mosser

[11] Patent Number: 4,714,256

[45] Date of Patent: Dec. 22, 1987

[54] AUTOMATIC RESET TARGET ASSEMBLY

[76] Inventor: Kenneth J. Mosser, P.O. Box 242, Clarissa, Minn. 56440

[21] Appl. No.: 889,876

[22] Filed: Jul. 28, 1986

[51] Int. Cl.[4] ..... F47J 7/04

[52] U.S. Cl. ..... 273/392

[58] Field of Search ..... 273/390, 391, 392, 386

[56] References Cited

U.S. PATENT DOCUMENTS 1,547,881 7/1925 Lambert ..... 273/392
1,657,931 1/1928 Krantz ..... 273/391 X
3,413,003 11/1968 Bell .

FOREIGN PATENT DOCUMENTS 285179 12/1952 Switzerland .

OTHER PUBLICATIONS

Target Masters Brochure—"Metallic Silhouette Target Shooting", 1/15/83.
American Rifleman publication, Jun. 1967.

*Primary Examiner*—Anton O. Oechsle
*Attorney, Agent, or Firm*—Burd, Bartz & Gutenkauf

[57] ABSTRACT

A target assembly comprising a target having a generally upright silhouette hinged to a base connected to a stake adapted to be anchored to the ground. An anchor remote from the target is connected thereto with an elongated flexible line containing a biasing spring. The spring biases the silhouette in a generally upright position thereby the silhouette will move to a down position when hit witha projectile and automatically return to an upright position after the force of the projectile has been dissipated.

22 Claims, 5 Drawing Figures

AUTOMATIC RESET TARGET ASSEMBLY

FIELD OF INVENTION

The invention is directed to automatic reset targets for projectiles. The target is a portable device having a silhouette held in a position so as to be hit with projectiles shot from firearms.

BACKGROUND OF INVENTION

This invention relates to a target assembly for use in shooting practice. Shooting, in general, has been popular since prehistoric days where there was rock throwing, spear tossing, and knife throwing. Today, silhouette shooting is enjoyed by many hobbyists and competitors. Targets for shooting practice are commonly used. These targets include clay discs and various cut-out figures or silhouettes, such as silhouettes of animals, beer cans or bottles, and human torsos. One target assembly comprises a cut-out silhouette rotatably mounted on a U-shaped frame anchored to a support or ground. A shaft extends downwardly from the center of the frame and is attached to the cut-out. The frame ends are inserted into the ground. When the silhouette is hit, it swings relative to the frame until stopped by gravitational forces. Another target assembly has silhouettes mounted on a rubber shock-absorbing member which is secured to a grounded stake. The silhouette and rubber bend rearwardly as they are hit by a projectile. The rubber member causes the silhouette to spring back to an upright position.

Prior target assemblies for shooting practice have had many difficulties. One major difficulty is resetting the silhouette to its original upright position when hit by a projectile. After being hit the silhouette continues to vibrate or to swing or is lying flat to the ground. There is a time elapse before the silhouette is fixed in an upright position. This mades the shooting of consecutive shots or rapid fire impractical and time consuming.

SUMMARY OF INVENTION

The invention is directed to a target assembly that automatically returns to a selected position after being hit with a moving projectile, such as a bullet. The target assembly has a target remotely positioned from an anchor. A line connected to a biasing spring operably connects the target with the anchor to yieldably position a silhouette mounted on the target in a generally upright position. The target assembly is portable and can be set up in a relatively short period of time in an appropriate shooting area.

One form of the invention has a target that includes a base secured to a downwardly directed stake. The stake is adapted to penetrate into the ground to anchor the target in a fixed position. The movable member is part of a hinge means that is connected to the base. The movable member is pivotally mounted on the base for movement between a generally upright position and a generally horizontal position. A silhouette in the shape of a selected outline form, such as an animal, bird, person torso, or the like, is attached to the movable member. The movable member normally holds the silhouette in a generally upright position making it a visible target for the shooter. An arm connected to the movable member is used with an elongated flexible line attached to a biasing spring to yieldably hold the silhouette in a generally upright position. The line is attached to an anchor that is secured to a support or ground remote from the target. The anchor is a generally upright bar having an anchor arm at its upper end. The line is attached to the anchor arm. The bar is adapted to be forced into the ground so as to maintain tension on the line to yieldably hold the silhouette in an upright position.

The target assembly automatically resets the silhouette in a generally upright position after the impact force of the projectile is dissipated. The entire target assembly is durable in construction and can take impacts from the bullets of all types of firearms handguns from BB to a 45 caliber and larger firearms. The target assembly is also useable in other types of target practice and competition, such as bow and arrow, cross bow, sling slot, golf, hand throwing or pitching of a ball. The above advantages and features of the target assembly are embodied in the following detailed description thereof.

DESCRIPTION OF PREFERRED EMBODIMENT

Figure 1:
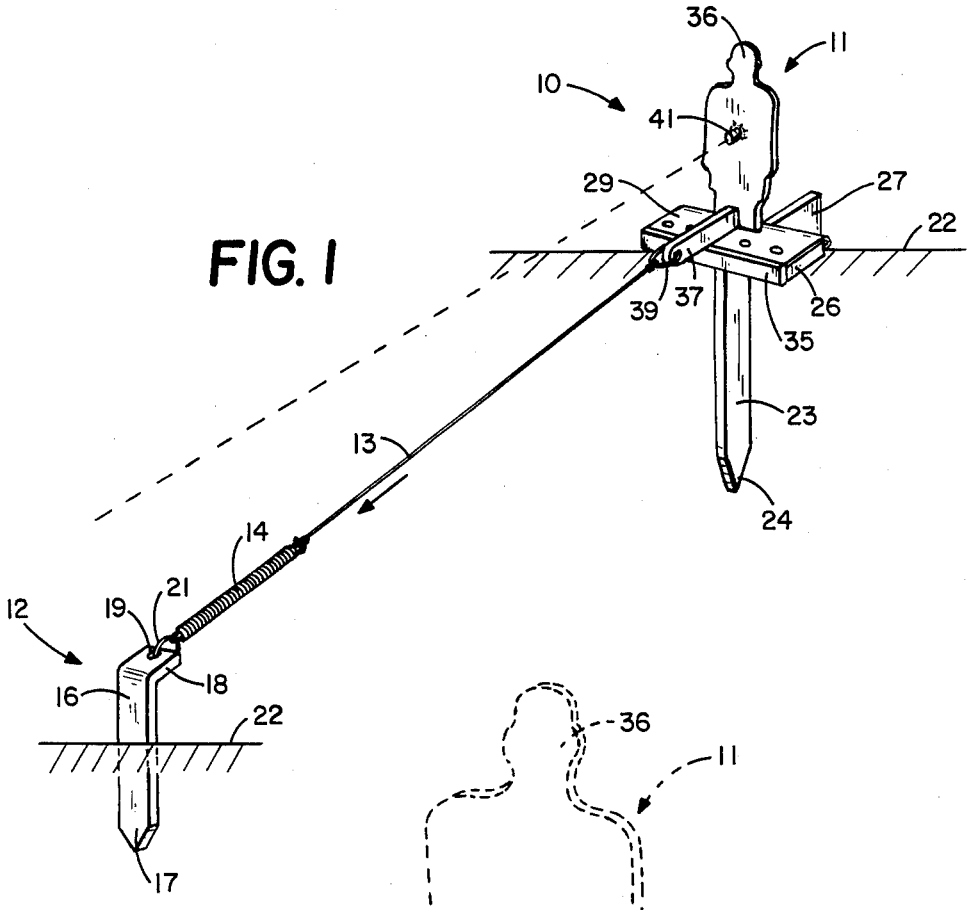
FIG. 1 is a perspective view of the target assembly of the invention anchored to the ground.
Figure 2:
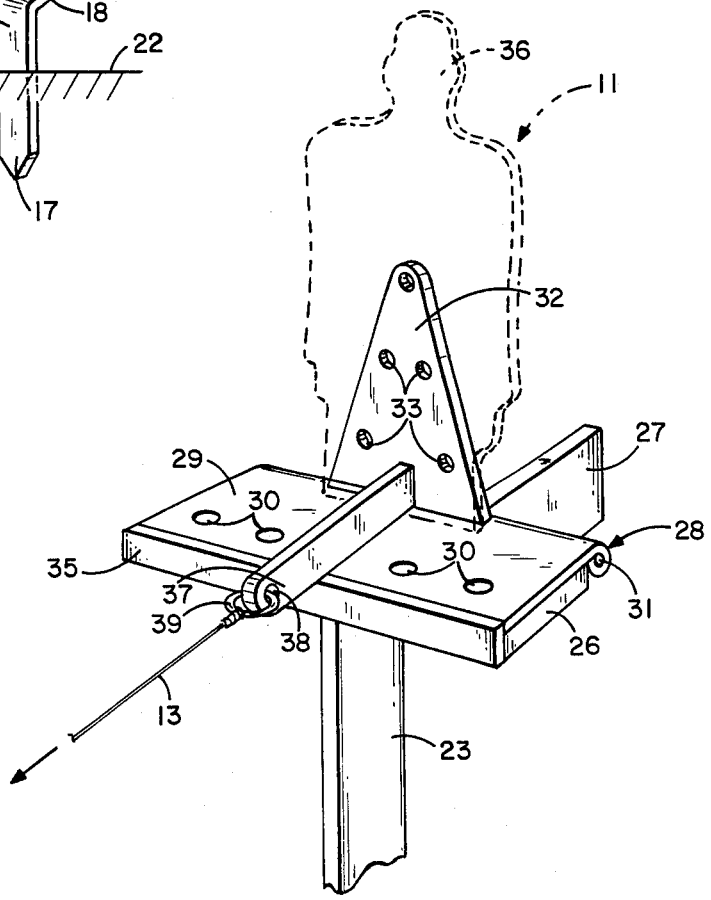
FIG. 2 is an enlarged perspective view of the target with the silhouette shown in broken lines.
Figure 3:
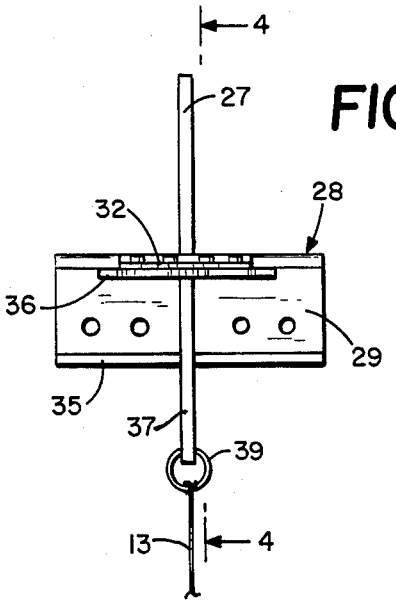
FIG. 3 is a top view of the target.

Referring to FIG. 1, there is shown an automatic reset target assembly of the invention indicated generally at 10 used for firearm practice. Target assembly 10 also can be used for other sport activities including but not limited to bow and arrow, cross bow, sling slot, golf, hockey, and like projectile devices.

Target assembly 10 has a target, indicated generally at 11, fixed to the ground. Target 11 can be attached to other supports. For example, when target assembly 10 is used indoors a support, such as a platform or floor is used to hold target 11. An anchor 12 is located in front of target 11. A long flexible line or cord 13 joined to a coil spring 14 connects target 11 with anchor 12. Coil spring 14 is normally under tension so as to continuously and yieldably hold the silhouette 36 in its upright position as seen in FIG. 1. When silhouette 36 is hit with a projectile 41, it swings backward against the biasing force of spring 14. Line 13 and spring 14 resets target 11 to its upright position.

Anchor 12 has an upright stake 16 terminating in a lower pointed end 17. The upper end of stake 16 is turned in a generally normal direction forming an anchor arm 18. Arm 18 has a hole 19 accommodating a ring 21 that joins tension coil spring 14 to arm 18. Stake 16 extends down into ground 22 to secure anchor 12 in a fixed location. In one form of the invention, anchor 12 has a stake 16 having a length of 8 inches and an anchor arm of 2 inches. Stake 16 is made of ¼ inch mild steel having a width of 1 inch. Anchor 12 can be attached to other fixed supports spaced from target 11.

Figure 4:
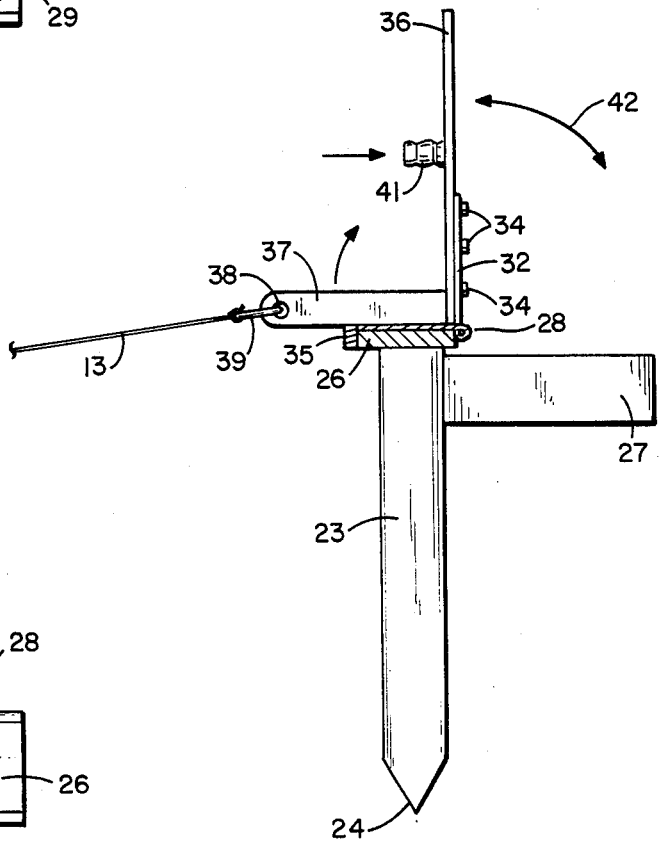
FIG. 4 is a sectional view taken along the line 4—4 of FIG. 3.
Figure 5:
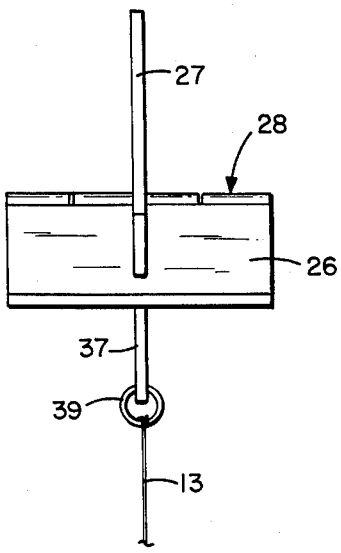
FIG. 5 is a bottom view of the target.

Target 11, as shown in FIGS. 1 and 4, has a generally upright stake 23 terminating in a lower pointed end 24. Stake 23 is a generally flat bar having a narrow forward edge so as to provide a minimum surface which can be hit with stray projectiles. In other words, the stake 23 is located along the longitudinal plane that is parallel to the direction of the flight path of the projectile. A horizontal transverse base 26 is secured by welds or the like to the upper end of stake 23. Base 26 is a flat block of metal having a rectangular box shape. A generally flat vertically disposed bar or stop member 27 is secured to the back of the upper end of stake 23 with welds or the like. A hinge, indicated generally at 28, is attached to the top of base 26. Hinge 28 has a first member or plate 29 that is secured to base 26 and a second generally upright member 32 pivotally joined to first member 29 with a generally horizontal pivot pin 31. Pin 31 and coiled part of plate 29 is located behind base 26 where it is protected from moving projectiles. First member 29 has a number of holes 30 that are filled with weld material and like fasteners to secure member 29 to the top of base 26. A cap plate 35 comprising a hard steel plate is secured with welds to the front edges of base 26 and member 29. Plate 35 protects base 26 and member 29 from projectiles, such as bullets. Second member 32 has a plurality of holes 33 accommodating fasteners 34, such as bolts or screws or welds that connect a silhouette member 36 to the forward side of member 32. Silhouette member 36 is shown as an outline of a person torso. Member 36 can have other configurations such as small animals, birds, or a simulated concentric circle target design. Silhouette member 36 is a hard steel plate that extends in an upright direction. Member 36 is relatively narrow as compared to its height. There is only minimal side pressure on the hinge when member 36 is hit with a projectile. Silhouette member 36 will flip over when hit with a projectile.

A forwardly directed arm 37 is secured to the center of the bottom of member 32. Arm 37 is normally located in a horizontal psosition in engagement with the top of member 29. Arm 37 has at its forward end a hole 38 accommodating a ring 39. Line 13, such as a nylon line, is secured to ring 39.

In use, stake 23 is inserted into the ground by applying a downward pressure on bar 27. Bar 27 can also be pushed into the ground thereby further anchoring target 11 to the ground. Anchor 12 is pressed into the ground in front of target 11. Line 13 is held tight with coil spring 14 under tension. This biases and holds the silhouette member 36 in its generally upright position. Arm 37 is generally horizontal and in engagement with the top of first member 29. First member 29 functions as a stop to yieldably hold silhouette member 36 in a generally upright position. Anchor 12 is forced into the ground to fix its position and hold coil spring 14 under tension.

As shown in FIG. 4, when a projectile 41, such as a bullet, strikes the silhouette member 36, hinge 28 allows silhouette member 36 to swing in a rearward direction as indicated by arrow 42. This swings second member 32 downwardly and backward until it strikes the top of bar 27. Arm 37 will be moved in a generally upright position. The movement of arm 37 is against the biasing force of coil spring 14. When the impact force of projectile 41 is dissipated, coil spring 14 will automatically return member 32 and silhouette member 36 to its upright position.

Target assembly 10 is usable for target practice and shooting competition with rifles and handguns. Preferably, rifles using 22 caliber long and 22 caliber magnum ammunition and handguns using 22 caliber long to 44 caliber magnum ammunition do not destroy the target 11 including the silhouette member 36.

While there has been shown and described a preferred embodiment of the invention, it is understood that changes in the structure, size of structure, materials, silhouette designs, and arrangement of the structure can be made by those skilled in the art without departing from the invention. The invention is defined in the following claims.

The embodiments of the invention in which an exclusive property or privilege is claimed are defined as follows:

1. A target assembly comprising: target means adapted to be hit with a movable projectile, said target means including a base, stake means secured to the base for anchoring the target means to a support, a movable member, hinge means connecting the member to the base for movement between a first generally upright position and a second generally horizontal position, silhouette means attached to the member, said member normally holding the silhouette means in a generally upright position, an arm connected to the member, anchor means attached to the support remote from the target means, and line means connected to the arm and anchor means, said line means including biasing means for biasing the member and silhouette means to the first generally upright position and allowing the silhouette means and member to move toward the second position when hit with a moving projectile.

2. The assembly of claim 1 wherein: said base is a generally flat block, said stake means having an upper end, said block being secured to said upper end of the stake means.

3. The assembly of claim 2 including: a generally flat upright bar secured to the stake means, said bar projected rearwardly in a generally horizontal direction provides a stop for the member and silhouette means when moved to the second position.

4. The assembly of claim 3 wherein: said arm projects in a forward generally horizontal direction when the member and silhouette means are in the upright position, said arm being engageable with said hinge means when located in said horizontal direction.

5. The assembly of claim 4 wherein: said biasing means includes coil spring means applying tension to said line means to yieldably hold the silhouette means in the generally upright position.

6. The assembly of claim 1 wherein: said hinge means includes a generally flat plate secured to said base to position the member in a generally upright position, said arm being engageable with said plate to locate said member in a generally upright position.

7. The assembly of claim 1 including: a bar secured to the stake means, said bar projected rearwardly in a generally horizontal direction providing a stop for the member and silhouette means when moved to the second position, said arm projected in a forward generally horizontal direction when the member and silhouette means are in the upright position, and stop means engageable with said arm when located in said horizontal direction, said biasing means yieldably holding said arm in said horizontal direction.

8. The assembly of claim 1 including: a bar secured to the base extended in a rearwardly generally horizontal direction from said base.

9. The assembly of claim 1 wherein: said biasing means includes a coil spring applying tension to said line means to yieldably hold the silhouette means and member in the generally upright position.

10. The assembly of claim 9 wherein: said line means includes an elongated flexible line connected to the coil spring means.

11. The assembly of claim 1 wherein: said anchor means has a linearly downwardly directed stake adapted to be attached to the support, said stake having an upper end, an anchor arm projected normal to said stake attached to said upper end, said line means being attached to said anchor arm.

12. A target assembly comprising: target means adapted to be hit with a movable projectile, said target means including a block having upper and lower surfaces, a stake having an upper end secured to the lower surface of the block adapted to be anchored to a support, a bar secured to the block and stake extended generally horizontal in a rearward direction from the block, a hinge secured to the block, said hinge having a first member secured to the block and a second member pivoted on the first member for movement from an upright position to a generally horizontal position, an arm secured to the second member, said arm extended in a forward direction and engageable with the first member to hold the second member in its upright position, silhouette means attached to said second members, and means including biasing means connected to said arm to yieldably hold said arm in engagement with said first member, said silhouette means when hit with a projectile being pivoted in a rearward direction, said biasing means pivoting the silhouette means back to the upright position.

13. The target assembly of claim 12 wherein: said first member is secured to the upper surface of the block and provides a stop engageable by the arm when the second member and silhouette means are located in the upright position.

14. The target assembly of claim 12 wherein: said means including biasing means connected to said arm includes anchor means attached to a support remote from the target means, and line means connected to the arm and anchor means, said line means including said biasing means.

15. The assembly of claim 14 wherein: said biasing means includes coil spring means applying tension to said line means to yieldably hold the silhouette means in a generally upright position.

16. The assembly of claim 14 wherein: said anchor means has a linearly downwardly directed stake adapted to be attached to the support, said stake having an upper end, a horizontal anchor arm attached to the upper end of the stake, said line means being attached to said anchor arm.

17. A target assembly comprising: target means adapted to be hit with a moving projectile, said target means including first means for anchoring the target means to a support, a movable member, second means connecting the movable member to the first means for movement between the first generally upright position and a second generally non-upright position, silhouette means attached to said member, said member normally holding the silhouette means in a generally upright position, and third means including an arm connected to the movable member, line means connected to the arm, and anchor means attached to the support remote from the target means connected to the line means, said line means including biasing means for biasing the movable member and silhouette means to the normally upright position and allowing said silhouette means and movable member to move to a non-upright position when hit with a projectile.

18. The assembly of claim 17 wherein: said first means includes a base and stake means secured to the base for anchoring the target means to a support.

19. The assembly of claim 17 wherein: said second means comprises a hinge having a first member secured to the first means, and said movable member pivotally mounted on the first member for movement between a first generally upright position and a second generally horizontal position.

20. The assembly of claim 17 wherein: said biasing means includes coils spring means applying tension to said line means to yieldably hold the silhouette means in a generally upright position.

21. The assembly of claim 17 including: flat bar means secured to the first means, said bar means projected rearwardly in a generally horizontal direction providing a stop for the movable member and silhouette means when moved to the second position.

22. The assembly of claim 17 including: a cap plate secured to the front of the first means to protect the first means from the moving projectile.

* * * * *